US006320745B1

(12) United States Patent
Chen

(10) Patent No.: US 6,320,745 B1
(45) Date of Patent: Nov. 20, 2001

(54) COOLING MECHANISM FOR ELECTRICAL DEVICE HAVING ROLLING SHAFT

(75) Inventor: Sun Chen, Shin-Chu (TW)

(73) Assignee: Mustek Systems, Inc., Shin-Chu (TW)

( * ) Notice: Subject to any disclaimer, the term of this patent is extended or adjusted under 35 U.S.C. 154(b) by 0 days.

(21) Appl. No.: 09/413,505

(22) Filed: Oct. 6, 1999

(51) Int. Cl.[7] ..... H05K 7/20
(52) U.S. Cl. ..... 361/695; 415/122.1; 415/176
(58) Field of Search ..... 361/687–688, 361/690, 694–695, 715; 615/122.1, 124.2, 175–718

(56) References Cited

U.S. PATENT DOCUMENTS 6,031,721 * 2/2000 Bhatia ..... 361/695

FOREIGN PATENT DOCUMENTS

4052166 * 2/1992 (JP) ..... 361/694

* cited by examiner

*Primary Examiner*—Gregory Thompson
(74) *Attorney, Agent, or Firm*—McGuireWoods, LLP

(57) ABSTRACT

An automatic cooling mechanism for an electrical device having a high-temperature element and a rolling shaft is provided. The mechanism includes a fan mounted within the electrical device; and a rotation transmission and variation mechanism connected between the fan and the rolling shaft for variationally transmitting rotational kinetic energy from the rolling shaft to the fan.

14 Claims, 5 Drawing Sheets

COOLING MECHANISM FOR ELECTRICAL DEVICE HAVING ROLLING SHAFT

FIELD OF THE INVENTION

The present invention relates to an automatic cooling mechanism, and more particularly to an automatic cooling mechanism for an electrical device having a rolling shaft.

BACKGROUND OF THE INVENTION

Today's electrical devices are required to have high integration and high performance. Accordingly, some of the electrical elements are often have high temperatures. For example, an automatic document feeder (ADF) is developed to be used with a flatbed scanner. The ADF can automatically feed document sheets one by one to the flatbed scanner to be scanned. However, most of the ADFs are asked to have reduced volumes and increased document-feeding speeds. As a result, a lot of heat is generated by the elements such as the print circuit board of the ADF. Cooling elements made of aluminum or copper, etc . . . are often used to reduce the temperature. However, the cooling effects are limited. The effect of a cooling cream is also limited. Furthermore, the cooling cream must be coated on the surface of the high-temperature uniformly, otherwise many problems may happen.

A more efficient method is to use a fan to cool the high-temperature element. However, conventional fan is equipped with a motor. The additional motor will also generate heat to increase the temperature within the electrical device. Furthermore, the additional motor will increase the cost.

It is then attempted by the applicant to deal with the above-mentioned problems.

SUMMARY OF THE INVENTION

An object of the present invention is to provide an efficient cooling mechanism for an electrical device.

Another object of the present invention is to provide a cooling mechanism for an electrical device without additional motor.

According to the present invention, an automatic cooling mechanism for an electrical device having a high-temperature element and a rolling shaft is provided.

According to the present invention, an automatic cooling mechanism for an electrical device having a high-temperature element and a rolling shaft is provided. The mechanism includes a fan mounted within the electrical device; and a rotation transmission and variation mechanism connected between the fan and the rolling shaft for variationally transmitting rotational kinetic energy from the rolling shaft to the fan.

According to one aspect of the present invention, the rotation transmission and variation mechanism is preferably a gear set having a first gear mounted on the rolling shaft and a second gear mounted on the fan and engaged with the first gear.

The second gear preferably has a radius larger than that of the first gear.

The second gear preferably further includes a plurality of holes for allowing air to pass therethrough.

According to another aspect of the present invention, the rotation transmission and variation mechanism preferably includes a rotary disk mounted on the fan and an elastic element connected between the rolling shaft and the rotary disk for transmitting rotational kinetic energy from the rolling shaft to the fan.

The rotary disk preferably includes a plurality of holes for allowing air to pass therethrough. The elastic element is preferably a belt or a rope.

According to the present invention, the electrical device preferably further includes a shell structure for receiving therein the high-temperature element. The fan can preferably introduce air into the shell structure. In another situation, the air filled within the shell structure may be exhausted by the fan.

The electrical device preferably further includes an air entrance/exist. The air entrance/exist preferably includes a plurality of holes formed on the shell structure.

Preferably, the electrical device is an automatic document feeder (ADF). The ADF preferably includes a plurality of rollers mounted on the rolling shaft for feeding thereby a document.

The present invention may best be understood through the following description with reference to the accompanying drawings, in which:

DETAILED DESCRIPTION OF THE PREFERRED EMBODIMENTS

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
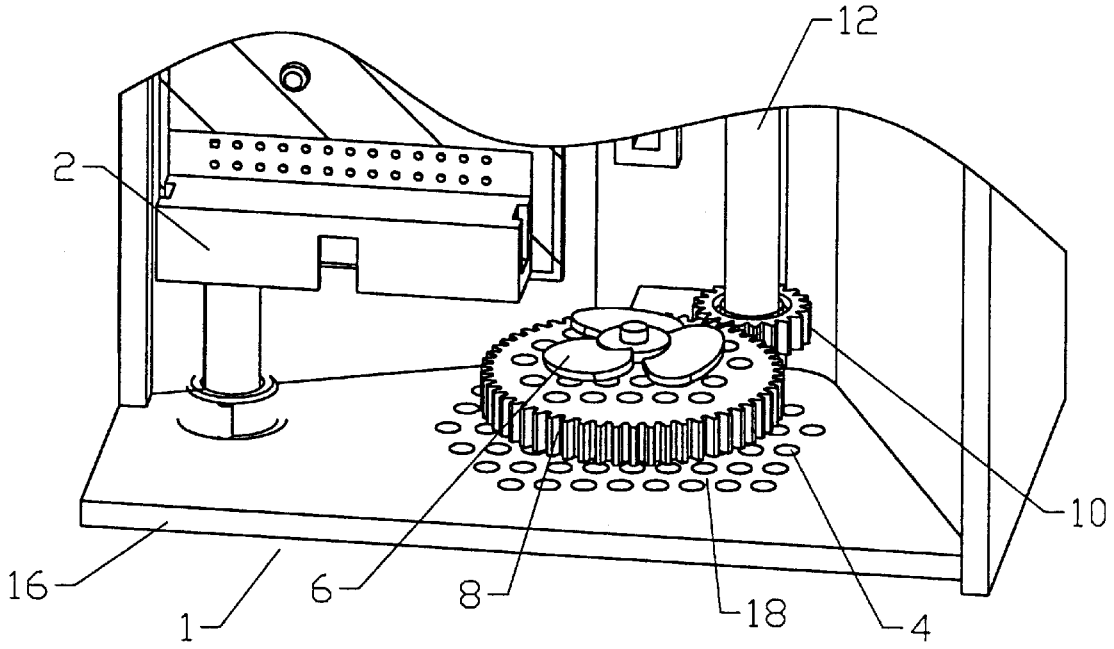
FIG. 1 illustrates an embodiment of a cooling mechanism for an electrical device according to the present invention.
Figure 2:
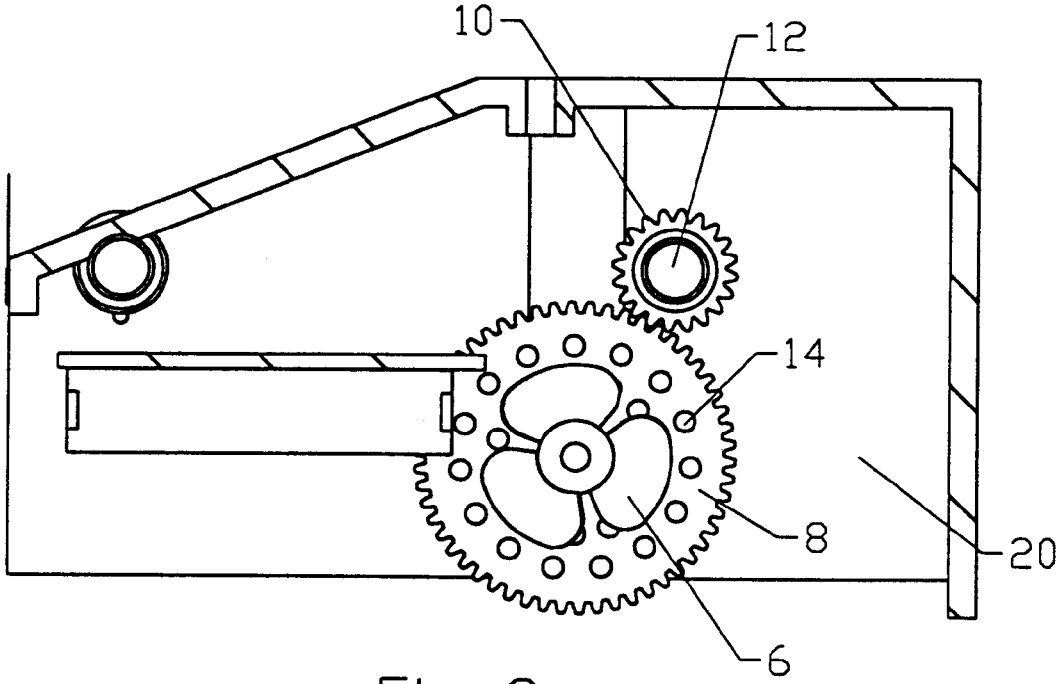
FIG. 2 illustrates the gear set of the cooling mechanism shown in FIG. 1.

Referring to FIG. 1 and FIG. 2, an electrical device 1 has a shell 16, a high-temperature element 2, and a rolling shaft 12. The high-temperature element 2 is a print circuit board (PCB) or other element that will generate heat during the operation of the electrical device 1. A cooling mechanism 4 is mounted within the electrical device 1. The cooling mechanism 4 includes a fan 6 and a gear set 20. The gear set 20 includes a first gear 10 mounted on the rolling shaft 12 and a second gear mounted on the fan 6. The second gear 8 is engaged with the first gear 10.

The fan 6 and the rolling shaft 12 are connected by the gear set 20. Accordingly, the fan will be rotated in accordance with the rotation of the rolling shaft 12. Consequently, a cool wind will blow to the high-temperature element 2 and reduce its temperature. The ratio of the radiuses of the first and second gears are specified to have a best performance of cooling. In most cases, the second gear may have a larger radius to obtain a higher rotation speed of the fan 6.

The fan 6 is mounted just beside the high-temperature element 2 to blow to the high-temperature element 2 directly. However, the fan 6 can also be mounted at any suitable place to introduce cool air into the shell 16 of the electrical device 1 to reduce the global temperature within the shell 16. Of course, the fan 6 can also served as an exhaust blower if it is rotated in a reverse direction.

A plurality of holes 14 are formed on the second gear to allow air to pass therethrough. For the same reason, an air entrance/exist is formed on the shell structure 16 of the electrical device 1. The air entrance/exist 18 may either allowing cool air to enter the shell structure 16, or allowing the hot air to be exhausted to the outside of the shell structure 16. The air entrance/exist 18 includes a plurality of holes formed on the shell structure 16. Of course, any other type of entrance/exist is available.

Figure 3:
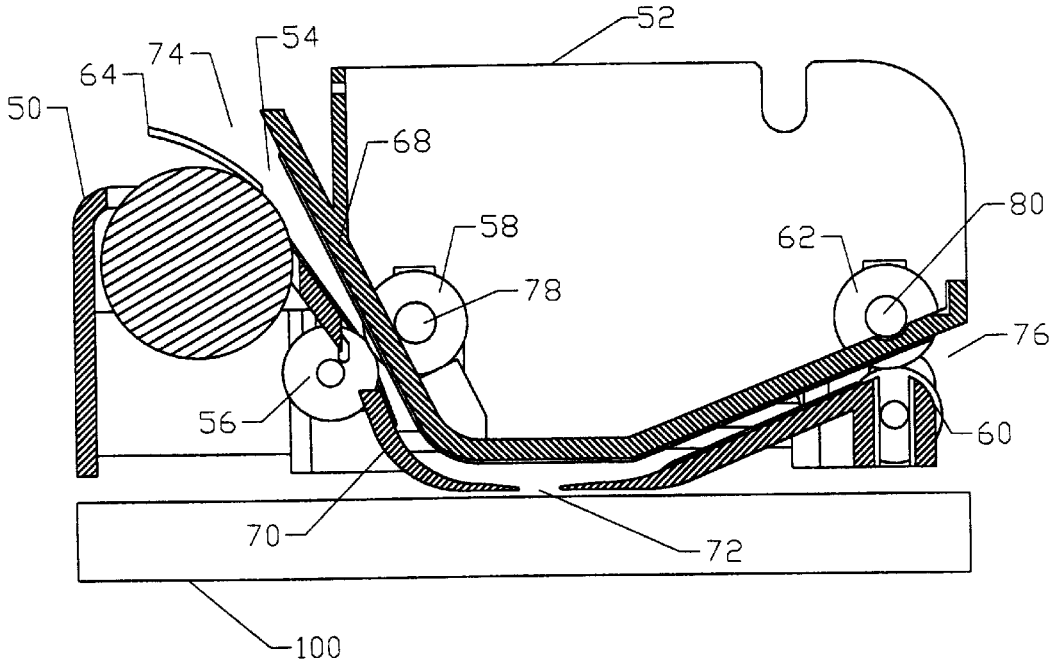
FIG. 3 illustrates an automatic document feeder (ADF) having rolling shafts.

The rolling shaft is not reserved for the use of the cooling mechanism. For example, in an automatic document feeder (ADF) for a scanner, the rolling shaft is a part of the sheet-feeding mechanism. Referring to FIG. 3, an ADF 50 includes a body shell 52, a document-feeding path 54 formed on the bottom side of the body shell 52, and rollers 56, 58, 60, and 62 for urging the document sheet 64 to be moved in the feeding path 54. The document-feeding path 54 is formed by an inner shell 68 and an outer shell 70. The document-feeding path 54 further includes a scanning area 72, which is an opening formed on the bottom of the outer shell 70. A document 64 is urged by the rollers 56; 58, 60, and 62 to be moved in the document-feeding path 54. The document 64 enters the document-feeding path 54 from the entry 74 and leaves it from the outlet 76. The ADF 50 is mounted on a flatbed scanner 100 and the scanning area 72 is aligned to the reading unit (not shown) of the scanner 100. While the document 64 passes through the scanning area 72, it will be scanned by the scanner 100.

Because rollers are necessary for the ADF to transmit document, rolling shafts are necessary to provide rolling kinetic energy to the rollers. For example, rollers 58 and 62 are mounted on rolling shafts 78 and 80 respectively. During operation of the ADF 50, the rollers 56 and 60 are also rolling since they contact with the rollers 58 and 62 respectively. Accordingly, the document sheet 64 will be transmitted forwardly once it passes the rollers 56 and 58 or 60 and 62.

Figure 4:
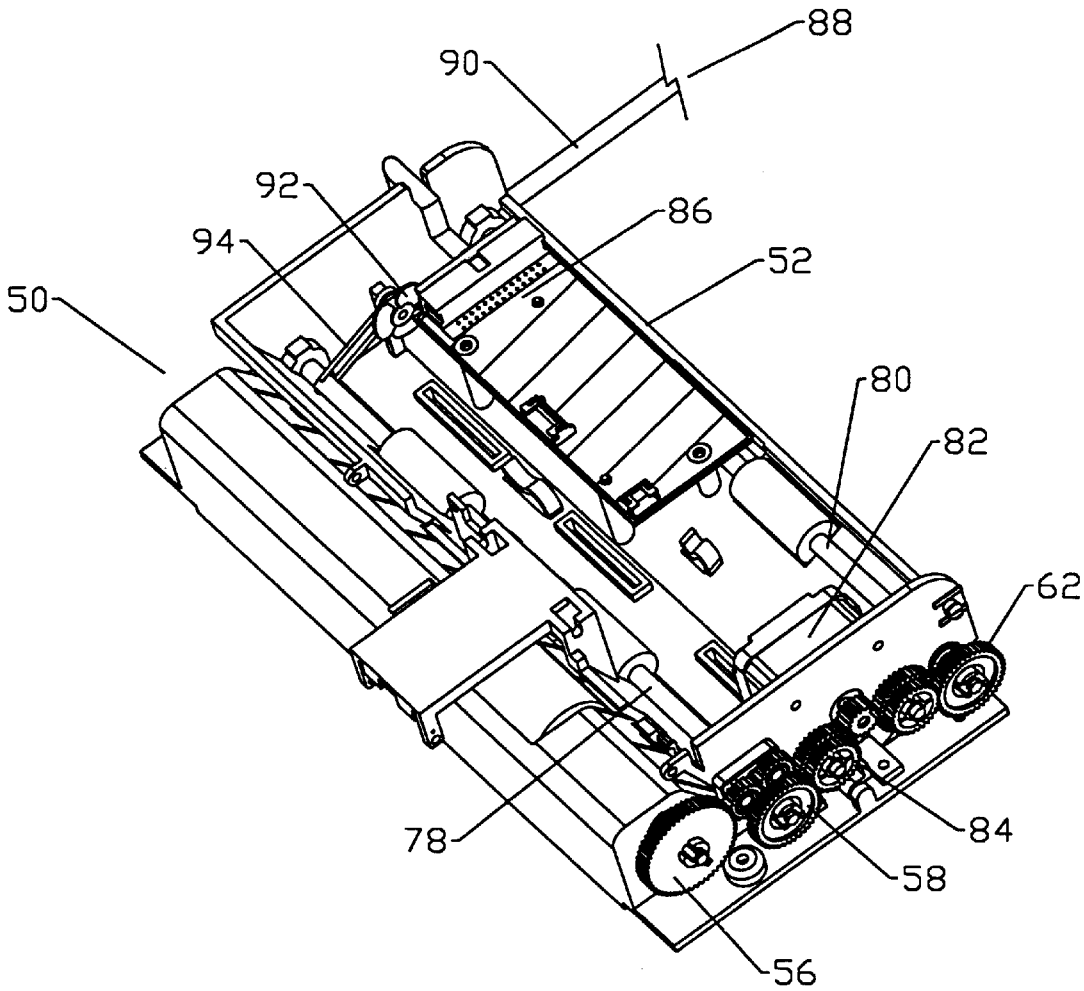
FIG. 4 shows an embodiment of a cooling mechanism mounted within the ADF illustrated in FIG. 3.

Referring to FIG. 4, the rotational kinetic energy of the rolling shafts 78 and 80 is provided by a motor 82 through the gear set 84. The ADF 50 further includes a PCB 86 connected to a power 88 by a wire 90. While the ADF 50 is operating, both the PCB 86 and the motor 82 will generate a considerable heat. Accordingly, a fan 92 is used to reduce the temperature within the body shell 52 of the ADF 50. In stead of using an additional motor, the fan 92 is connected to the rolling shaft 78 by a rotation transmission and variation mechanism 94 (e.g. a gear set) to obtain the rotational kinetic energy.

Figure 5:
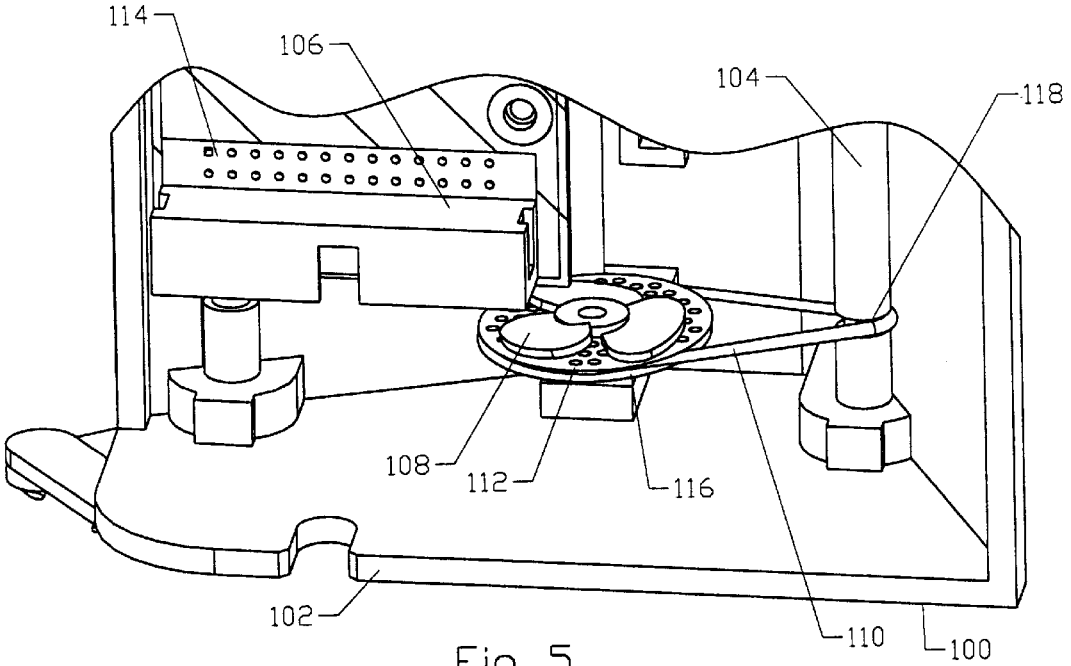
FIG. 5 illustrates another embodiment of a cooling mechanism for an electrical device according to the present invention.

The rotation transmission and variation mechanism is not necessary a gear set. For example, as shown in FIG. 5, an elastic element 110 and a rotary disk 112 or other rotation transmission/variation mechanism is also available. The electrical device 100 has a shell 102, a high-temperature element 106, and a rolling shaft 104. The high-temperature element 106 is a print circuit board or other element that will generate heat during the operation of the electrical device 100. A fan 108 is used for reducing the temperature within the shell structure 102. The fan 108 is combined with a rotary disk 112. An elastic element 110 (e.g. a belt or a rope) is connected between the rotary disk 112 and the rolling shaft 104. Slots 116 and 118 are respectively formed on the edge of the rotary disk 112 and the rolling shaft 104 respectively to receive therein the elastic element 110. The rotary disk 112 has a radius larger than that of the rolling shaft so that a higher rotation speed of the fan 108 can be obtained. The rotary disk 112 includes a plurality of holes 114 for allowing air to pass therethrough.

The present invention can not only be applied on the above-mentioned ADF, but also any other electrical device having a rolling shaft for a specified function. Since no additional motor is needed for the cooling mechanism of the present invention, the cost is reduced. Furthermore, the defect that an additional motor will further increase the temperature of the electrical device is avoided. Accordingly, the present invention is valuable for the industry.

While the invention has been described in terms of what are presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An automatic cooling mechanism, comprising:

a fan mounted within an electrical device which contains a high temperature element;

a rolling shaft; and a rotation transmission and variation mechanism connected between said fan and said rolling shaft for variationally transmitting rotational kinetic energy from said rolling shaft to said fan;

wherein said rotation transmission and variation mechanism is a gear set having a first gear mounted on said rolling shaft and a second gear mounted on said fan and engaged with said first gear.

2. An automatic cooling mechanism according to claim 1, wherein said second gear has a radius larger than that of said first gear.

3. An automatic cooling mechanism according to claim 1, wherein said second gear further includes a plurality of holes for allowing air to pass therethrough.

4. An automatic cooling mechanism, comprising:

a fan mounted within an electrical-device which contains a high temperature element;

a rolling shaft; and a rotation transmission and variation mechanism connected between said fan and said rolling shaft for variationally transmitting rotational kinetic energy from said rolling shaft to said fan;

wherein said rotation transmission and variation mechanism includes a rotary disk mounted on said fan and an elastic element connected between said rolling shaft and said rotary disk for transmitting rotational kinetic energy from said rolling shaft to said fan.

5. An automatic cooling mechanism according to claim 4 wherein said rotary disk includes a plurality of holes for allowing air to pass therethrough.

6. An automatic cooling mechanism according to claim 4 wherein said elastic element is a belt.

7. An automatic cooling mechanism according to claim 4 wherein said elastic element is a rope.

8. An automatic cooling mechanism according to claim 1 wherein said electrical device further includes a shell structure for receiving therein said high-temperature element.

9. An automatic cooling mechanism according to claim 8 wherein said fan generates air into said shell structure.

10. An automatic cooling mechanism according to claim 8 wherein the air filled within said shell structure is exhausted by said fan when said fan is rotated in a reverse direction.

11. An automatic cooling mechanism according to claim 1 wherein said electrical device further includes an air entrance/exist.

12. An automatic cooling mechanism according to claim 11 wherein said air entrance/exist includes a plurality of holes formed on said shell structure.

13. An automatic cooling mechanism according to claim 1 wherein said electrical device is an automatic document feeder (ADF).

14. An automatic cooling mechanism according to claim 13 wherein said ADF includes a plurality of rollers mounted on said rolling shaft for feeding thereby a document.

* * * * *